US009516907B2

(12) United States Patent
Guidry

(10) Patent No.: US 9,516,907 B2
(45) Date of Patent: Dec. 13, 2016

(54) SOLAR-ASSISTED GARMENT

(71) Applicant: Elizabeth A Guidry, Fremont, CA (US)

(72) Inventor: Elizabeth A Guidry, Fremont, CA (US)

( * ) Notice: Subject to any disclaimer, the term of this patent is extended or adjusted under 35 U.S.C. 154(b) by 564 days.

(21) Appl. No.: 14/033,813

(22) Filed: Sep. 23, 2013

(65) Prior Publication Data

US 2015/0083704 A1 Mar. 26, 2015

(51) Int. Cl.
*H05B 3/00* (2006.01)
*A41D 19/015* (2006.01)
*A41D 19/00* (2006.01)

(52) U.S. Cl.
CPC ..... *A41D 19/01535* (2013.01); *A41D 19/0024* (2013.01)

(58) Field of Classification Search
CPC ..... A41D 13/0051; A41D 13/0038; A41D 19/0024; A41D 19/01535; H05B 2203/036; H05B 3/342
IPC ..... A41D 13/0051, 13/0038, 19/0024, 19/01535; H05B 2203/036, 3/342
See application file for complete search history.

(56) References Cited

U.S. PATENT DOCUMENTS 4,950,868 A * 8/1990 Moss ..... A41D 13/0051 219/211
6,005,222 A 12/1999 Hicks
6,049,062 A 4/2000 Jones
6,239,410 B1 * 5/2001 Tackore ..... A41D 19/01535 219/211
6,649,873 B1 11/2003 Cintron, Jr. et al.
8,370,965 B2 2/2013 Lin et al.
2012/0028080 A1 * 2/2012 Truitt ..... H01M 2/1022 429/7
2012/0074128 A1 * 3/2012 Blackford ..... A41D 13/0051 219/487

* cited by examiner

*Primary Examiner* — Brian Jennison

(74) *Attorney, Agent, or Firm* — Matthew J. Lattig; Charter IP, LLC

(57) ABSTRACT

A solar-assisted garment is described, which includes a garment body having a rear surface panel, front surface panel and interior surface between the panels, a solar panel on the front surface panel, a heating element in electrical communication with the solar panel and a rechargeable battery so that as the solar panel generates electrical current the heating element generates heat within the interior surface, the rechargeable battery in electrical communication with the solar panel for storing energy from the solar panel, and to provide electric current to the heating element. The garment further includes a USB device for charging the battery using one or more of a laptop, PC, or AC charger adaptor to an AC mains, and a DC charging adapter plug adjacent the USB device for permitting charging of the battery via connection to a secondary DC/DC universal adapter that in turn is connected to a DC power source.

18 Claims, 5 Drawing Sheets

SOLAR-ASSISTED GARMENT

BACKGROUND

1. Field

Example embodiments generally relate to a solar-assisted garment, more particularly to a glove, wrap and animal blanket incorporating a solar panel and electrical storage means in electrical communication with the solar panel.

2. Related Art

Maintenance and support for warmth in cold weather environments contributes to more comfortable working conditions, enjoyable recreational activities, natural disaster/national disaster emergency relief efforts, and survival in some instances.

Presently available cold weather garments have limited capabilities due to the technology that has been presented as solutions. Clothing available offers warmth by covering the body and relies on the temperature of the body and insulation of the clothing, which in many instances is insufficient for the wearer.

One active solution is battery powered clothing, but this solution has very limited capabilities due to the capacity of power storage, short life of the battery, and costs to maintain. The reliance on battery power that is supplied is impractical for a long term need of warmth. The needed support solely relying on batteries adds to the cost of maintenance due to the recurring need for batteries. High maintenance costs, limited low capacity short life batteries, and the inconvenience of the requirement for the continuous purchasing of additional batteries are all limiting factors. Extending the heating capabilities, the flexibility to support additional charging methods, as well as localization of the heat with minimal maintenance issues, is desirable.

Lighter fluid-fueled hand warmers are available for support of an auxiliary source of heat. There are chemically activated 'hand warmer' heat packs which are available and cater to short term certain situations. The use of lighter fluid based hand warmers poses potentially hazardous conditions as a smoldering canister of flammable liquid is introduced into one's garment. Also, chemical heat packs last for limited durations and after initial activation, a boiling point needs to be reached in order to subsequently activate. Due the required method to regenerate the chemical heat packs for further uses, such as boiling water, it is impractical for remote outdoor needs. For cold outdoor weather work and various recreational activities this is not feasible as there is likely no power or no capability to bring the required equipment.

As mentioned above, battery operated garments have limited capabilities and in addition are costly to maintain and inconvenient due to the need for continuous battery replacement and the inability in some cases to acquire replacement batteries in remote areas or in natural disaster situations. Extending the heating capabilities, the flexibility to support additional charging methods, as well as localization of the heat with minimal maintenance issues, is desirable.

The example embodiments to be discussed in detail hereafter provide an environmentally friendly solution by utilizing solar technology and energy storage. In remote areas such inaccessibility to battery products does not lend itself to proper maintaining the warmth required. The present inventor is unaware of cold weather garments that provide each of: (1) environmentally friendly warming solution and energy storage (2) several options for maintaining continuous heat for extended periods of time by utilizing various methods for charging the storage device, (3) temperature control, (4) the ability for outside or ambient temperature information. It would be very beneficial for those wearers involved in cold weather environments to have a garment that exhibits these outlined characteristics that are currently lacking in present cold weather garment solutions.

SUMMARY

An example embodiment is directed to a solar-assisted glove. The glove includes a glove body having fingers, a rear surface, front surface and interior space for placing a hand therein, a protective collar for encircling a wearer's wrist at a bottom of the glove body and terminating in a securable release flap on an underside of the wrist below the front surface of the glove body, a solar panel on the rear surface collecting incident solar rays and generating an electrical current in response thereto, a heating element provided in the interior space of the glove body and connected to a printed circuit board (PCB), wherein the heating element is in electrical communication with the solar panel and PCB so that as the solar panel generates electrical current the heating element generates heat within the interior space, and a rechargeable electrical storage means in electrical communication with the solar panel, connected to the PCB and kept on a trickle discharge while storing energy from the solar panel, so as to provide electric current to the heating element. The glove further includes a USB device in electrical communication with the electrical storage means and extending below the glove body front surface for charging the electrical storage means using one or more of a laptop, PC, and AC charger adaptor to an AC mains, and a DC charging adapter plug adjacent the USB device for permitting charging of the electrical storage means via connection to a secondary DC/DC universal adapter that in turn is connected to a DC power source.

Another example embodiment is directed to a solar-assisted garment. The garment includes a garment body having a rear surface panel, front surface panel and interior surface between the panels, a solar panel on the front surface panel collecting incident solar rays and generating an electrical current in response thereto, a heating element provided in the interior surface and in electrical communication with the solar panel so that as the solar panel generates electrical current the heating element generates heat within the interior surface, and a rechargeable battery in electrical communication with the solar panel for storing energy from the solar panel, and to provide electric current to the heating element. The garment further includes a USB device for charging the battery using one or more of a laptop, PC, or AC charger adaptor to an AC mains, and a DC charging adapter plug adjacent the USB device for permitting charging of the battery via connection to a secondary DC/DC universal adapter that in turn is connected to a DC power source.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 2:
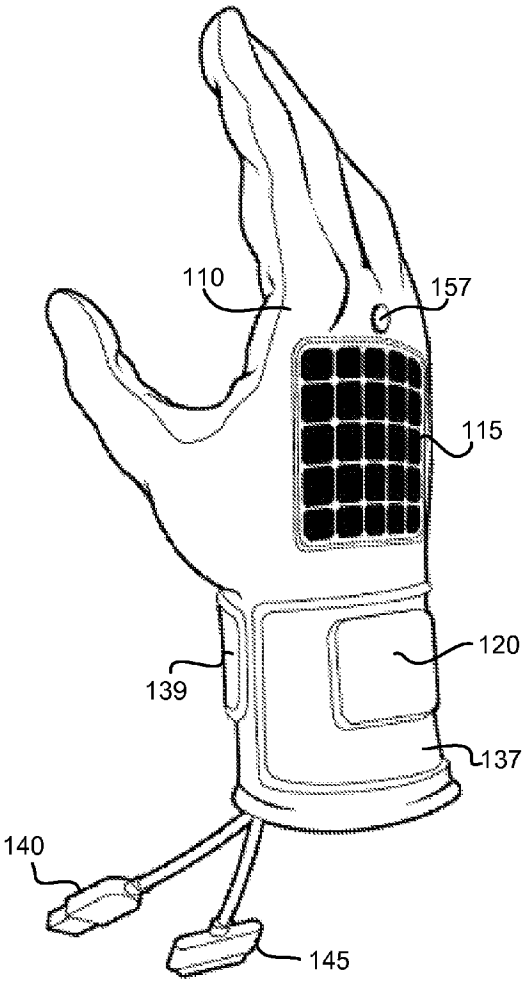
FIG. 2 is a perspective view of the garment shown in FIG. 1.
Figure 1:
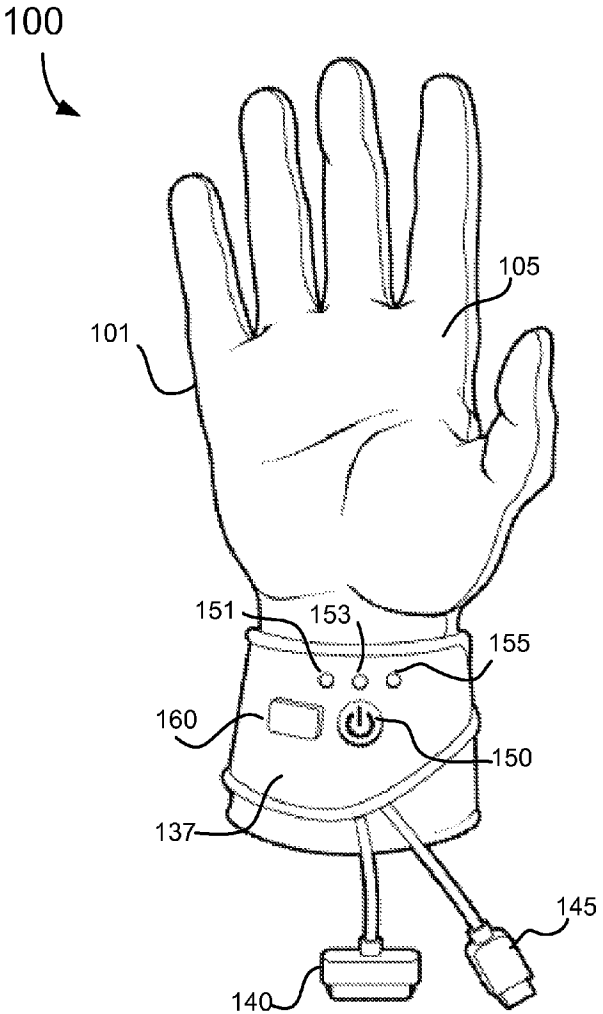
FIG. 1 is a front view of a solar-assisted garment according to an example embodiment.
Figure 4:
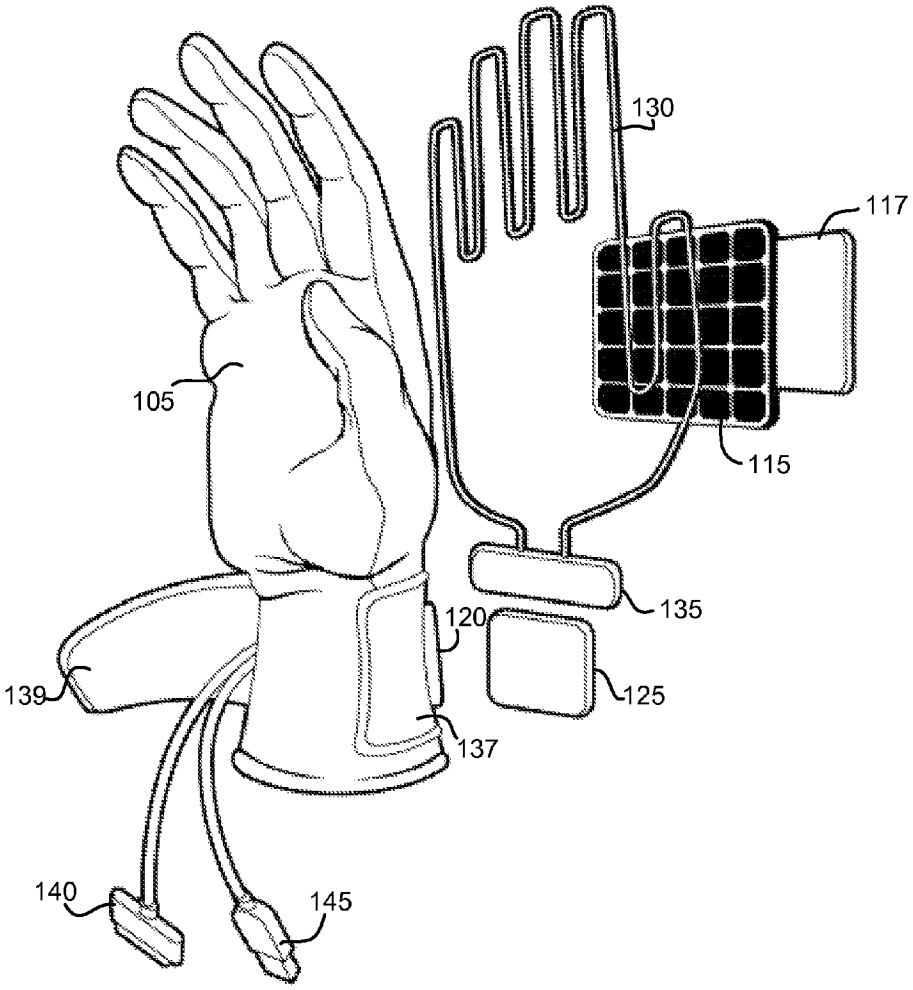
FIG. 4 is a partial exploded view of the garment shown in FIG. 1.
Figure 3:
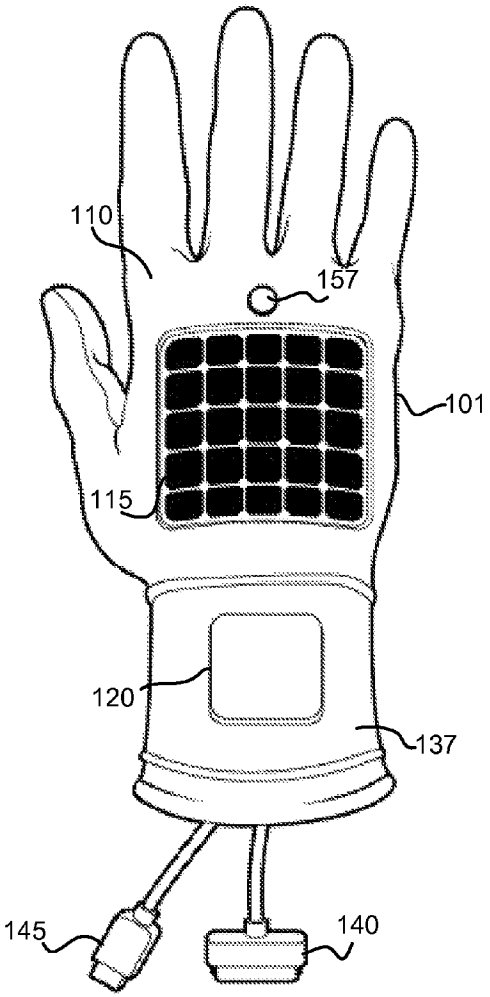
FIG. 3 is a rear view of the garment shown in FIG. 1.

FIG. 1 is a front view of a solar-assisted garment according to an example embodiment; FIG. 2 is a perspective view of the garment shown in FIG. 1; FIG. 3 is a rear view of the garment shown in FIG. 1; and FIG. 4 is a partial exploded view of the garment shown in FIG. 1. Referring to FIGS. 1-4, garment 100 is shown in the configuration of a glove (hereafter "glove 100"). The glove 100 includes a glove body 101 with fingers, having a front surface 105, and a rear surface 110 on which is positioned a solar panel 115 with a protective cover 117 covering an external surface of the solar panel 115. The solar panel 115 is configured to collect incident solar rays thereon for generating an electrical current in response thereto.

The glove body 101 includes a protective collar 137 for encircling a wearer's wrist at a bottom of the glove body 101 and terminating in a securable release flap 139 on an underside of the wrist below the front surface of the glove body 101. The rear surface 110 includes a storage compartment 120 (on collar 137) for a rechargeable electrical storage means 125 which is in electrical communication with the solar panel 115 within an interior space of the glove 100 (not shown), such as between layers of material forming the glove body 101. Additionally, the glove 100 includes a flexible heating element 130 provided in the interior space of the glove body 101 (between layers of material forming the glove body 101, not shown for reasons of brevity) and connected to a printed circuit board (PCB) 135 within the collar 137. The heating element 130 is in electrical communication with the solar panel 115, rechargeable electrical storage means 125, and PCB 135 so that as the solar panel 115 generates electrical current the heating element 130 generates heat within the interior space of glove 100. The heating element 130 is flexible and bendable.

The rechargeable electrical storage means 125 is stored within the storage compartment 120 on collar 137. Specifically, the rechargeable electrical storage means 125 is within the collar 137 and located where a back side of a wearer's wrist would be when wearing the glove 100. The electrical storage means 125 is in electrical communication with the solar panel 115, connected to the PCB 135 and kept on a trickle discharge while storing energy from the solar panel 115

This is so as to provide electric current to the heating element 130. In an example, the rechargeable electrical storage means 125 can be configured as a Li-ion or lithium polymer battery, although the example embodiments are not so limited as the rechargeable electrical storage means 125 is contemplated to be any future storage cell, battery or solar storage cell construction, and/or possibly configured as an array of photovoltaic (PV) cells.

The electrical storage means 125 is designed to be recharged from at least two different sources (AC and DC sources). Accordingly, a USB device 140 is provided below the glove body front surface 105 and inside of the release flap 139 for charging the electrical storage means 125, using one or more of a laptop, PC, and AC charger adaptor to plug into an AC mains. In an example, the AC adaptor is an off-the-shelf component that can be purchased from any electronics store, such as an eForCity™ 2-port home wall AC outlet USB charge plug, so that the USB 140 is connected to the AC adapter which in turn is plugged into an AC wall outlet. Further, there is provided a DC charging adapter plug 145 adjacent the USB device 140 for permitting charging of the electrical storage means via connection to a secondary DC/DC universal adapter that in turn is connected to a DC power source. The secondary DC/DC universal adapter is an off-the-shelf component such as a Rhino™ 2500 mA DC/DC car adapter that is configured to receive multiple types of charging plug tips. The DC power source is envisioned as a lighter receptacle or a 12 VDC charging port on a motorcycle or within an automobile.

The rear surface 110 of the glove body 101 includes a temperature sensor 157 arranged thereon, shown just above the solar panel 115. Temperature sensor 157 is in communication with the PCB 125 and can be embodied by a thermocouple, thermistor or metallic RTD, for example. Temperature sensor 157 senses external or ambient temperature and provides a signal to the PCB 125 which in turn displays a reading on an LCD 160 that is positioned on the release flap 139 of collar 137.

There is provided an ON/OFF/SELECT button 150 on the release flap 139 and a set of three LEDs 151, 153, 155. Each LED represents a specific glove internal temperature range that is to be set by actuation of the ON/OFF/SELECT button 150, which functions as a temperature controller as it is in operative communication with the PCB 135 and hence heating element 130, solar panel 115 and electrical storage means 125. LED 151 when lit represents that the glove interior is set at a temperature of 105° F.+/−2 degrees; LED 153 when lit represents that the glove interior is set at a temperature of 110° F.+/−2 degrees; and LED 155 when lit represents that the glove interior is set at a temperature of 115° F.+/−2 degrees.

In operation, a wearer presses the ON/OFF/SELECT button 150 once to turn on the first LED 151, then presses the ON/OFF/SELECT button 150 twice in rapid succession to bring up a menu on LCD 160 that as a default displays the center temperature of the range (105° F.). The wearer can then press the ON/OFF/SELECT button 150 to drop down incrementally in internal glove temperature up to 2 degrees (104° F. or 103° F., displayed on LCD 160), or jump up in temperature (to 106° F. or 107° F.). Once the desired internal temperature is set, the wearer presses the ON/OFF/SELECT button 150 and holds for 2 seconds. If a higher temperature range is desired, the wearer simply presses the ON/OFF/SELECT button 150 to toggle to the next range (LED 153 and/or LED 155), and may (or may not) repeat the process described above to select the desired temperature in that range.

Figure 6:
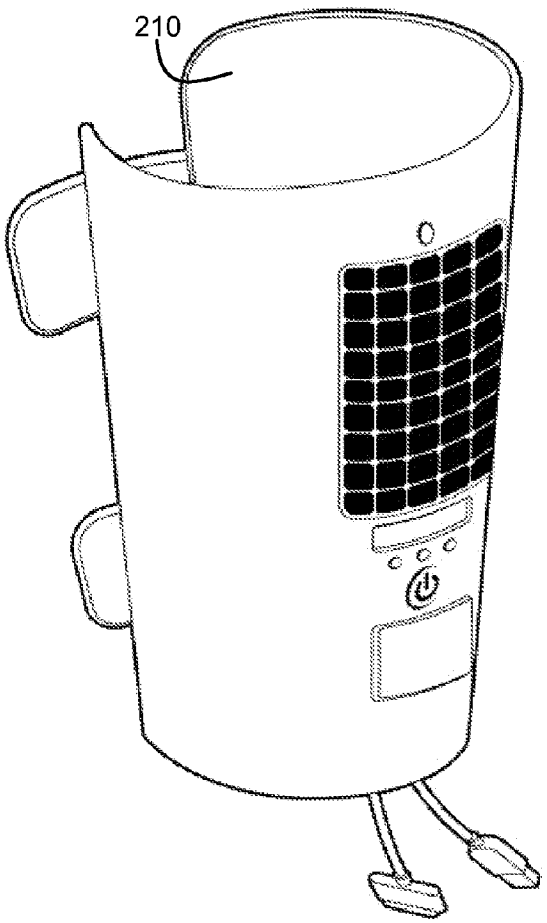
FIG. 6 is a perspective view of the garment shown in FIG. 5.
Figure 5:
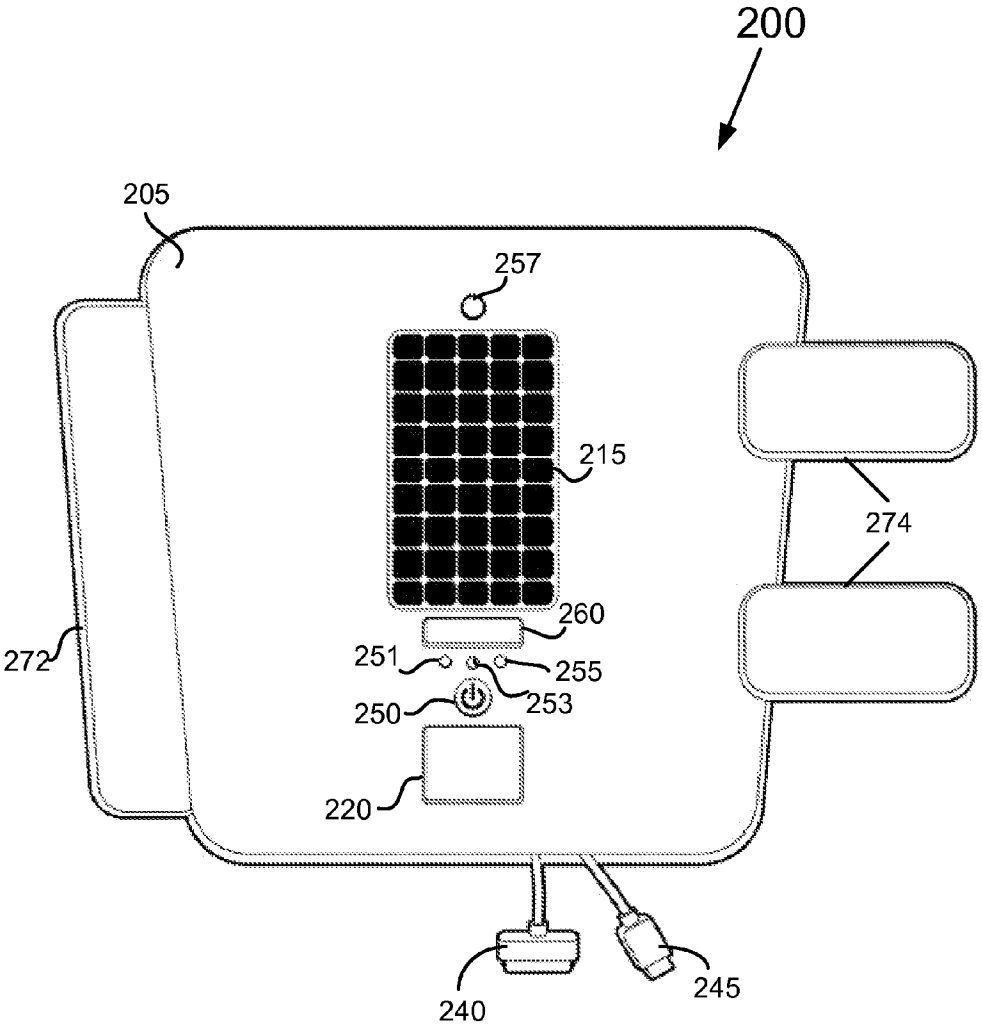
FIG. 5 is a front view of a solar-assisted garment according to another example embodiment.
Figure 7:
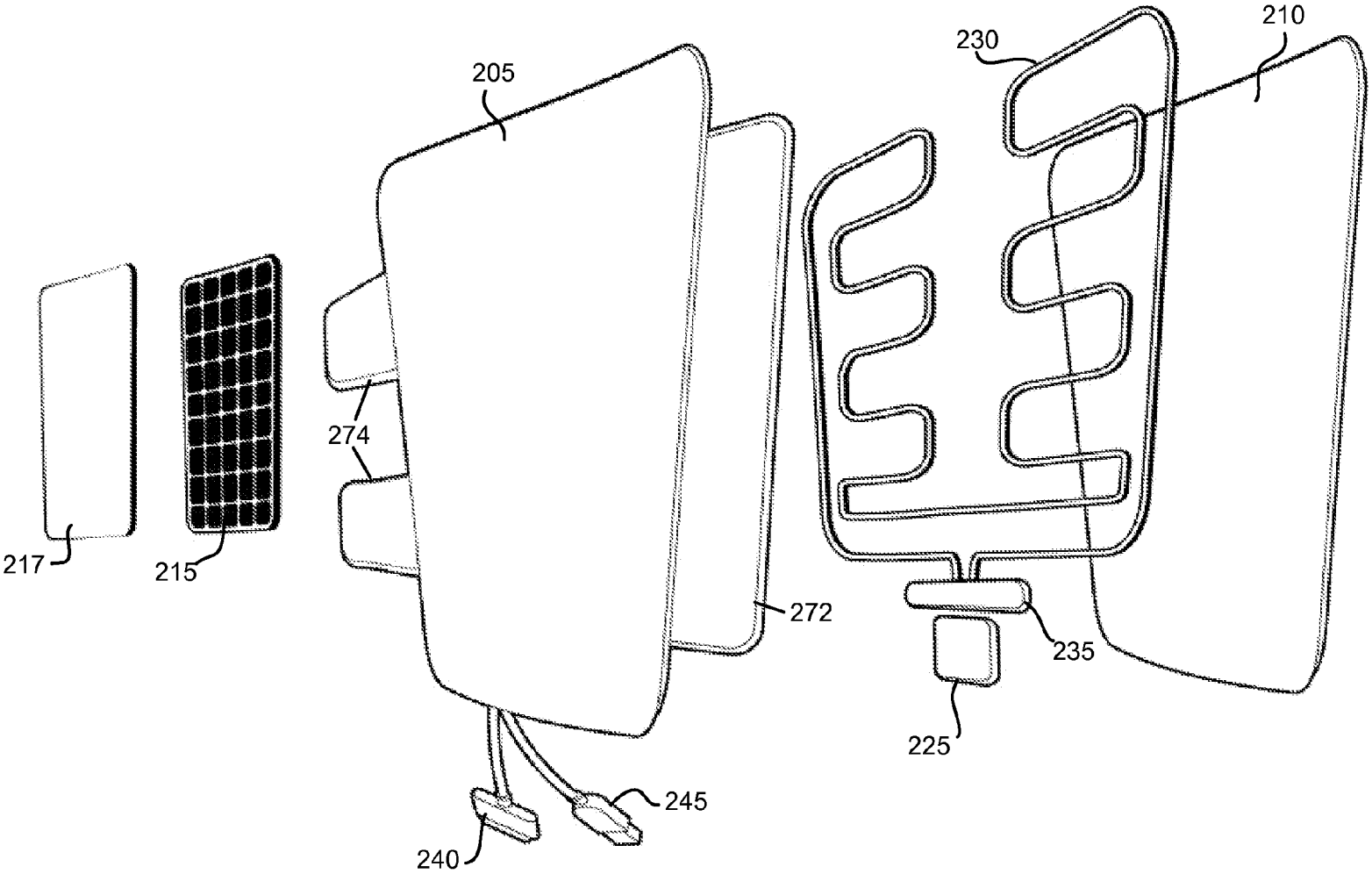
FIG. 7 is a partial exploded view of the garment shown in FIG. 5.

FIG. 5 is a front view of a solar-assisted garment according to another example embodiment; FIG. 6 is a perspective view of the garment shown in FIG. 5; and FIG. 7 is a partial exploded view of the garment shown in FIG. 5. Referring to FIGS. 5-7, there is shown another garment in accordance with the example embodiments; this garment is configured as a "wrap" to wear around an arm or a thigh. The wrap 200 includes many of the same constituent components as glove 100 in FIGS. 1-4, thus only the differences are described in detail. Wrap 200 includes a garment body composed of a front surface panel 205, rear surface panel 210 and interior surface or space for electronics (not shown) between the panels. The front and rear surface panels 205, 210 are sewn or otherwise bonded along a periphery edge thereof, so as to provide the interior surface or space for electronics.

The solar panel 215 on the front surface panel 205 collects incident solar rays and generates an electrical current in response thereto. The heating element 230 is provided in the interior surface and in electrical communication with the solar panel 215 so that as the solar panel 215 generates electrical current, the heating element 230 generates heat within the interior surface or space. The heating element 230 is flexible and bendable. A rechargeable battery 225 is in electrical communication with the solar panel 215 for storing energy from the solar panel 215, and to provide electric current to the heating element 230.

Similar to FIGS. 1-4 there is a USB device 240 for charging the battery 225 using one or more of a laptop, PC, or AC charger adaptor to an AC mains. Additionally, there is the DC charging adapter plug 245 adjacent the USB device 240 for permitting charging of the battery 225 via connection to a secondary DC/DC universal adapter that in turn is connected to a DC power source, which could be a lighter receptacle or a 12 VDC charging port on a motorcycle or within an automobile.

The wrap 200 includes the temperature sensor 257, LCD 260, LEDs 251, 253, 255 and ON/OFF/SELECT button 250 as in the previous embodiment, each arranged on the front surface panel 205. Temperature control of the wrap 200 is effected as previously described above regarding the glove 100, with the exception that it is the internal temperature of the wrap 200 that is adjustable by way of the ON/OFF/SELECT button. Additionally, the side edges may include hook and loop fasteners such as Velcro straps 272, 274. These straps 272, 274 are on opposed side edge surfaces thereof for securing the wrap 200 around a human appendage such as an arm or thigh, for example.

Figure 8:
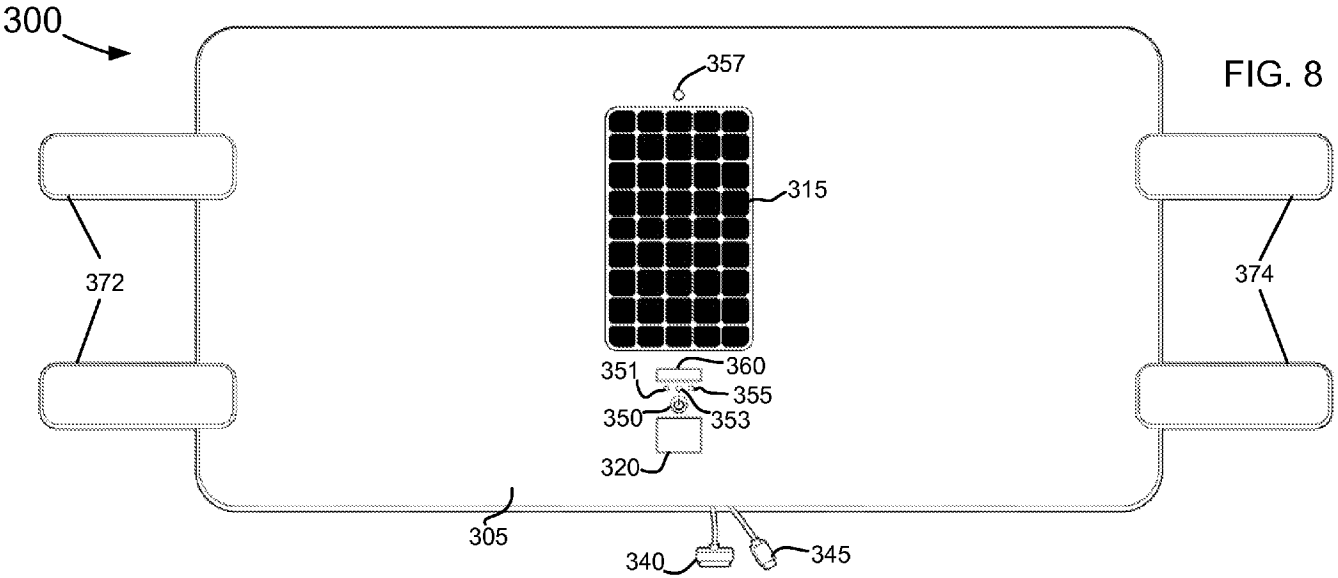
FIG. 8 is a front view of a solar-assisted garment according to another example embodiment.
Figure 9:
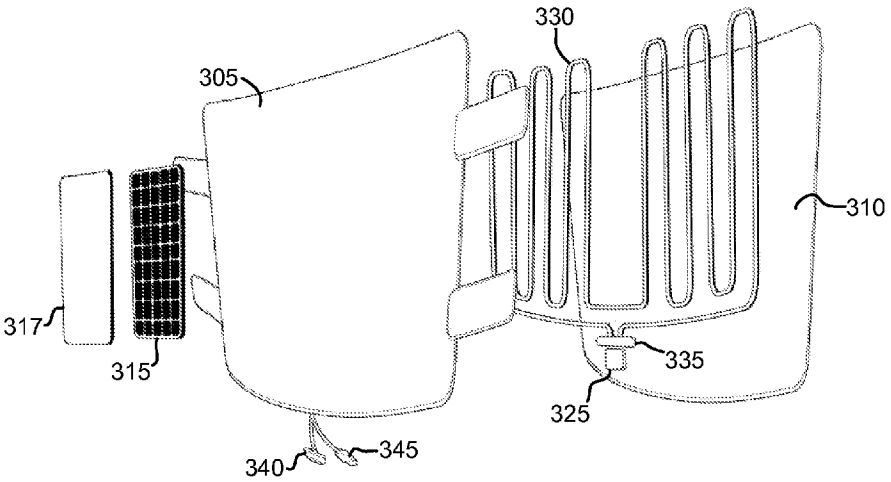
FIG. 9 is a partial exploded view of the garment shown in FIG. 8.

FIG. 8 is a front view of a solar-assisted garment according to another example embodiment, and FIG. 9 is a partial exploded view of the garment shown in FIG. 8. Referring to FIGS. 8 and 9, here the garment 300 is configured as an animal blanket such as is used for pets or horses, in which the blanket may be wrapped around the mid-section or torso of the animal for warmth and comfort. As constituent components in blanket 300 are essentially the same as for glove 100 and wrap 200, a detailed explanation thereof is omitted for purposes of brevity.

Accordingly, the example embodiments have shown cold weather garments that provide an environmentally friendly warming solution and energy storage, which provides extended use of the garment by utilizing solar and energy storage technologies in conjunction with one another. Additionally, the use of USB device and a DC charging adapter plug provides several options for maintaining continuous heat for extended periods of time by utilizing various methods for charging the electrical storage means. Each garment is provided with temperature control, as well as the ability to discern outside or ambient temperature information on an LCD positioned on the garment.

The example embodiments being thus described, it will be obvious that the same may be varied in many ways. Such variations are not to be regarded as departure from the example embodiments, and all such modifications as would be obvious to one skilled in the art are intended to be included in the following claims.

I claim:

1. A solar-assisted glove, comprising:

a glove body having fingers, an interior space, a rear surface, front surface, and a cuff portion serving as the bottom of the glove body and having an opening to receive a wearer's hand within the interior space, the cuff portion adapted to encircle the wearer's wrist, a protective collar adapted to encircle a wearer's wrist, a first end of the collar attached to a section of the cuff portion where a back side of a wearer's wrist would be when wearing the glove, a second end of the collar terminating in a securable release flap that is adapted to extend around an underside of the wearer's wrist over the cuff portion of the glove with a distal tip of the flap releasably securable to the cuff portion to secure the wearer's hand in the glove, a solar panel provided on the glove body rear surface as a primary source of generating energy for heating the glove, the solar panel covering a substantial portion of the rear surface of the glove body above the cuff portion and adapted to collect incident solar rays and generate an electrical current therefrom, a heating element provided in the interior space of the glove body and connected to a printed circuit board (PCB), wherein the heating element is in electrical communication with the solar panel and PCB so that as the solar panel generates electrical current the heating element generates heat within the interior space, a rechargeable electrical storage in electrical communication with the solar panel PCB and kept on a trickle discharge while storing energy from the solar panel, the rechargeable electrical storage device adapted to be primarily charged by the solar panel from incident solar rays so as to power the heating element, an ON/OFF/SELECT button located on an outer surface of the release flap of the collar so as to be accessible to the wearer at the underside of the wearer's wrist with the glove on the hand and flap secured to the cuff portion, the ON/OFF/SELECT button in operative communication with the PCB and adapted to function as a temperature controller to vary temperature within the interior space of the glove, in addition to its function to provide or terminate current to the heat elements via the solar panel and electrical storage means, and a corded USB plug end adapted for remote AC charging of the rechargeable electrical storage device arranged adjacent to a separate corded DC charging adapter plug end adapted for remote DC charging of the rechargeable electrical storage device, the opposite cord ends of each being in electrical communication with the electrical storage means, with each of the USB and DC charging adapter plug ends adapted to be extended below the opening in the cuff portion for connection to a respective remote AC charging source and remote DC charging source.

2. The glove of claim 1, further comprising:

a temperature sensor provided on the rear surface for detecting ambient temperature.

3. The glove of claim 1, further comprising:

LCD element provided on the release flap of the collar for displaying ambient temperature and internal glove temperature to the wearer, the LCD also configured to display a menu of internal glove temperatures selectable by actuation of the ON/OFF/SELECT button by the wearer.

4. The glove of claim 1, further comprising:

a protective cover provided on an external surface of the solar panel.

5. The glove of claim 1, wherein the remote DC charging source is a lighter receptacle or 12 VDC charging port on a motorcycle or within an automobile, each of the receptacle or port adapted to receive the corded DC charging adapter plug end via a DC/DC universal adapter.

6. The glove of claim 1, further comprising:

a plurality of horizontally oriented and adjacently-spaced LEDs attached to the flap outer surface above the ON/OFF/SELECT button, wherein each LED when lit provides an indication of a specific glove internal temperature within a given range that has been selected by the wearer, and a given internal glove temperature is settable via sequential actuation of the ON/OFF/SELECT button by the wearer to toggle between different selectable internal glove temperatures, a selected internal glove temperature indicated by its correspondingly lit LED.

7. The glove of claim 6, further comprising:

a LCD element provided on the release flap of the collar and configured to display a menu of internal glove temperatures selectable by actuation of the ON/OFF/SELECT button by the wearer, wherein once a desired internal glove temperature is selected by the wearer, the ON/OFF/SELECT button is depressed and held by the wearer for a given duration to set the selected internal glove temperature, indicated by its corresponding LED being lit.

8. The glove of claim 1, further comprising:

an external storage compartment attached to a portion of the collar on the cuff portion at the glove body rear surface, the storage compartment configured to secure the rechargeable electrical storage means therein.

9. The glove of claim 1, wherein the solar panel is a generally square-shaped panel that covers a substantial portion of the glove body rear surface, extending in a first direction between the index and pinky fingers of the glove, and extending in a second direction between below where the fingers meet the glove body rear surface down toward the collar on the cuff portion thereof.

10. The glove of claim 1, wherein the remote AC charging source is selected from a group comprising a laptop, PC, and an AC charger adaptor to an AC mains.

11. A solar-assisted glove, comprising:

a glove body having fingers, an interior space, a rear surface, a front surface, and a cuff portion serving as the bottom of the glove body and having an opening to receive a wearer's hand within the interior space, the cuff portion adapted to encircle the wearer's wrist, a protective collar adapted to encircle a wearer's wrist, a first end of the collar attached to a section of the cuff portion where a back side of a wearer's wrist would be when wearing the glove, a second end of the collar terminating in a securable release flap that is adapted to extend around an underside of the wearer's wrist over the cuff portion of the glove with a distal tip of the flap releasably securable to the cuff portion of the glove body to secure the wearer's hand in the glove, a solar panel provided on a hack-hand side of the glove body opposite a palm side and covering a substantial portion of the back-hand side above the cuff portion, the solar panel being the primary source of generating energy for heating the glove, a heating element provided in the interior space of the glove body and connected to a printed circuit board (PCB) and the solar panel no that as the solar panel generates electrical current the heating element generates heat within the interior space, a rechargeable battery pack in electrical communication with the solar panel and PCB, the battery pack primarily charged by the solar panel so as to power the heating element, an ON/OFF/SELECT button located on an outer surface of the release flap and electrically connected to the PCB to provide and terminate current to the heating element via the solar panel and rechargeable battery pack, and further adapted to function as a temperature controller to vary temperature within the interior space of the glove, and a plurality of horizontally oriented and adjacently-spaced LEDs attached to the release flap outer surface above the ON/OFF/SELECT button, wherein each LED when lit is an indication of a specific glove internal temperature within a given range that has been selected by the wearer, and a given internal glove temperature is settable via sequential actuation of the ON/OFF/SELECT button by the wearer to toggle between different selectable internal glove temperatures, the selected internal glove temperature indicated by its correspondingly lit LED.

12. The glove of claim 11, further comprising:

a LCD element provided on the release flap of the collar and configured to display a menu of internal glove temperatures selectable by actuation of the ON/OFF/SELECT button by the wearer, wherein once a desired internal glove temperature is selected by the wearer, the ON/OFF/SELECT button is depressed and held by the wearer for a given duration to set the selected internal glove temperature, indicated by its corresponding LED being lit.

13. The glove of claim 11, further comprising:

a USB cord having a first end attached to the battery pack and a second end terminating in a USB plug for remote AC charging of the pack, and a separate DC charging cord having a first end attached to the battery pack and a second end terminating in a DC charging adapter plug for remote DC charging of the pack.

14. A solar-assisted glove, comprising:

a glove body having fingers, a cuff portion adapted to encircle a wearer's wrist, serving as the bottom of the glove body, and having an opening to receive a wearer's hand within an interior space of the glove body, a protective collar adapted to encircle a wearer's wrist and attached at a first end to the cuff portion and having a second end terminating in a securable release flap that is adapted to wound the cuff portion with a distal tip of the flap releasably securable to the cuff portion to secure the wearer's hand in the glove, a solar panel provided on a back-hand side of the glove body opposite a palm side and covering a substantial portion of the back-hand side above the cuff portion, the solar panel being the primary source of generating energy for heating the glove, a heating element provided in the interior space of the glove body and connected to a printed circuit board (PCB) and the solar panel no that as the solar panel generates electrical current the heating element generates heat within the interior space, a rechargeable battery pack in electrical communication with the solar panel and PCB, the battery pack primarily charged by the solar panel so as to power the heating element, and a secondary dual charging source for charging the battery pack, the secondary charging source having both an AC and a DC charging component.

15. The glove of claim 14, further comprising:

an ON/OFF/SELECT button to provide and terminate current to the heating element via the solar panel and rechargeable battery pack, and further adapted to function as a temperature controller to vary the internal glove temperature, a plurality of horizontally oriented and adjacently-spaced LEDs, each LED when lit being an indication of a specific glove internal temperature within a given range that has been selected by the wearer via the ON/OFF/SELECT button, and a LCD element configured to display a current ambient temperature, a currently internal glove temperature as selected by the wearer, and a menu of internal glove temperatures selectable by actuation of the ON/OFF/SELECT button by the wearer, wherein each of the ON/OFF/SELECT button, LEDs, and LCD element are attached to an outer surface of the release flap so as to be easily accessible to the wearer at the underside of the wrist with the glove on the hand and flap secured to the cuff portion.

16. The glove of claim 15, wherein a given internal glove temperature is settable via a sequential pressing of the ON/OFF/SELECT button by the wearer to toggle between different selectable internal glove temperatures, and once a desired internal glove temperature is selected by the wearer, the ON/OFF/SELECT button is depressed and held by the wearer for a given duration to set the selected internal glove temperature, indicated by its corresponding LED being lit.

17. The glove of claim 14, wherein the AC charging component is embodied as a USB cord having a first end attached to the battery pack and a second end terminating in a USB plug that is connectable to a remote AC charging source for AC charging the pack, and the DC charging component is embodied as a separate DC charging cord having a first end attached to the battery pack and a second end terminating in a DC charging adapter plug that is connectable to a remote DC charging source for DC charging of the pack.

18. The glove of claim 17, wherein the remote DC charging source is a lighter receptacle or 12 VDC charging pork on a motorcycle or within an automobile adapted to receive the corded DC charging adapter plug end via a DC/DC universal adapter, and the remote AC charging source is selected from a group comprising a laptop, PC, and an AC charger adaptor to an AC mains.

* * * * *